US011285979B2

(12) United States Patent
Berke et al.

(10) Patent No.: US 11,285,979 B2
(45) Date of Patent: Mar. 29, 2022

(54) NON-POWERED SHUNTING AND TRACK CIRCUIT DISCONNECT MECHANISM FOR RAILWAY SWITCH MACHINE, RAILWAY SWITCH MACHINE AND RAILWAY SWITCHING SYSTEM INCLUDING SAME

(71) Applicant: HITACHI RAIL STS USA, INC., Pittsburgh, PA (US)

(72) Inventors: Brian C. Berke, Allison Park, PA (US); Frank Durkac, Mars, PA (US); William J. Moltz, Pittsburgh, PA (US)

(73) Assignee: HITACHI RAIL STS USA, INC., Pittsburgh, PA (US)

( * ) Notice: Subject to any disclaimer, the term of this patent is extended or adjusted under 35 U.S.C. 154(b) by 349 days.

(21) Appl. No.: 16/415,350

(22) Filed: May 17, 2019

(65) Prior Publication Data

US 2019/0351921 A1 Nov. 21, 2019

Related U.S. Application Data

(60) Provisional application No. 62/673,392, filed on May 18, 2018.

(51) Int. Cl.
*B61L 5/10* (2006.01)

(52) U.S. Cl.
CPC ..... *B61L 5/10* (2013.01)

(58) Field of Classification Search
CPC .. B61L 5/10; B61L 5/102; B61L 5/107; B61L 5/06
See application file for complete search history.

(56) References Cited

U.S. PATENT DOCUMENTS

| | | | | |
|---|---|---|---|---|
| 2,740,041 | A | 3/1956 | Marcum | |
| 5,669,587 | A | 9/1997 | Van Alstine et al. | |
| 5,806,809 | A | 9/1998 | Danner | |
| 6,296,208 | B1 | 10/2001 | Franke | |
| 6,484,974 | B1 | 11/2002 | Franke et al. | |
| 7,753,318 | B2 * | 7/2010 | Wagner | B61L 5/107 246/220 |

(Continued)

OTHER PUBLICATIONS

International Searching Authority, International Search Report and the Written Opinion for International Application No. PCT/US2019/032818, dated Aug. 2, 2019.

*Primary Examiner* — Robert J McGarry, Jr.
(74) *Attorney, Agent, or Firm* — Eckert Seamans Cherin & Mellott, LLC

(57) ABSTRACT

A mechanism for use in a railway switch machine includes an elongate contact body having a housing formed from a non-conductive material, a plurality of electrical contact rails disposed in or on the contact body, and a contact block slidably coupled to the contact body such that the contact block can generally freely slide along the contact body. The contact block has a plurality of moveable contacts positioned thereon facing the contact body and is structured to engage a point detector bar of the railway switch machine. The contact block is moveable along the contact body from among: a first position in which a first and second rail of the plurality of contact rails are electrically connected and a third and fourth rail of the plurality of contact rails are electrically connected, and a second position in which only the second and third rails are electrically connected.

15 Claims, 17 Drawing Sheets

(56) References Cited

U.S. PATENT DOCUMENTS

| | | | |
|---|---|---|---|
| 2009/0072097 | A1 | 3/2009 | Arnold |
| 2017/0137046 | A1 | 5/2017 | Mariuzza, Jr. et al. |
| 2018/0093682 | A1 | 4/2018 | McQuistian et al. |

* cited by examiner

NON-POWERED SHUNTING AND TRACK CIRCUIT DISCONNECT MECHANISM FOR RAILWAY SWITCH MACHINE, RAILWAY SWITCH MACHINE AND RAILWAY SWITCHING SYSTEM INCLUDING SAME

CROSS-REFERENCE TO RELATED APPLICATIONS

This patent application claims the priority benefit under 35 U.S.C. § 119(e) of U.S. Provisional Application No. 62/673,392 entitled "Non-Powered Shunting and Track Circuit Disconnect Mechanism for Railway Switch Machine, Railway Switch Machine and Railway Switching System Including Same", filed on May 18, 2018, the contents of which are herein incorporated by reference.

BACKGROUND OF THE INVENTION

1. Field of the Invention

The present application relates to railway switch machines and, more particularly, to mechanisms which provide for basic point indication which is readily installable and un-installable. The present application also relates to railway switch machines and railway switching systems including such mechanisms.

2. Description of the Related Art

A railway switch machine is used to divert a train from one track to another track. In many cases, the switch machine is remotely operated and, thus, an operator cannot see the machine. Consequently, the status of the machine (e.g., points detected and mechanically locked for either a straight-through or turn-out move) is provided by electrical circuits that, in turn, are interlocked with signals governing movement of the trains. According to typical convention, the term Normal (N) is employed for a straight-through move and the term Reverse (R) is employed for a turn-out move.

Historically, indication circuits for switch machines were implemented with cam operated or other types of mechanical switches comprised of hard contacts within the machine. In some cases, the indication contacts of one machine are electrically connected in series with other machines in series for a cross-over to provide a system safety connection to both sets of points. All interconnected machines must prove that their points are closed and mechanically locked before railroad signals are cleared for traffic, in order to permit movement of associated trains.

Motor control is also provided by mechanical switches via hard contacts. Basically, the motor rotates in opposite directions for Normal and Reverse. Rotary motion of the motor is converted to linear motion within the machine to move and lock the points. If the motor is being driven Normal, then contacts within the machine open the circuit path that would, otherwise, permit continued movement in that direction when the limit of intended motion is reached. However, a path is maintained that permits movement in the Reverse direction. In between the extreme positions, both current paths are closed for movement of the motor in either direction. It is known to assign Right Hand Points Closed (RHPC) or Left Hand Points Closed (LHPC) to Normal by orientation of cam operated switches.

With mechanical controllers, a battery voltage is fed from the wayside case to contacts of a first switch machine. Then, if those contacts are closed, the battery voltage is fed on to the next machine, and so on. If all the contacts in the series string are closed, then the voltage fed back to the wayside case proves all switch machines are in correspondence, which is a condition necessary to vitally clear signals.

Electronic circuit controllers have been developed which improve upon such mechanical devices. For example, U.S. Pat. No. 6,484,974, the contents of which are incorporated herein by reference, discloses an example of such an electronic circuit controller (ECC). The ECC is a microprocessor controlled device used to sense the position of rail points within a turnout(s) or "switch". Similar to purely mechanical sensing systems, the sensing of the points is provided by a point detector bar which attaches to heavy metalwork binding two switch points together at a set distance. The point detector bar is able to slide freely within the controller compartment of the switch machine. Unlike purely mechanical systems which utilize cams to interact with the point detector bar, a target attached to the point detector bar is utilized which is aligned with an inductive proximity sensor in each switch position. Other sensors are mounted under the mounting plate to sense the lock box position at the end of each move (near and far point positions). The lock box (which mechanically locks the track in its full thrown position), when used, prohibits unintended point movement until unlocked for the next switch move. As another example, U.S. Pub. No. 2018/0093682, the contents of which are incorporated herein by reference, discloses an example of an intelligent electronic circuit controller (IECC) which improves upon an arrangement such as described in U.S. Pat. No. 6,484,974.

A problem with any switch machine equipped with an ECC or IECC device is that there is the potential for an initial installation where power to the switch machine and the ECC or IECC is not yet provided and thus the ECC or IECC is not operational. During such temporary state, the switch point is locked to the running rails but indication of point movement (during a failure or normal maintenance movement) is still required. Currently, a small-scale solution that is easily installed and removed does not exist for providing indication of point movement. Presently, there are two solutions to this problem, but both are of a rather large scale and rather complicated to install/uninstall. The first solution is to install a Mechanical Circuit Controller (predecessor to the ECC/IECC) in place of the ECC/IECC during this temporary period and reinstall the IECC when power is applied to the switch machine. The second solution is to install an external point monitoring device such as an Ansaldo U5 controller. This adds complexity to the switch layout as the U5 and the switch machine normally occupy the same physical space. Both stated solutions can perform a single shunt of the rail and double break of the track circuit signaling when the point moves ¼". Both solutions also require a high level of labor to implement and remove during the temporary period. Additionally, both solutions are deemed expensive.

Accordingly, there remains a need to provide a readily implemented and subsequently readily removed solution for providing point indication in a new switch machine installation.

SUMMARY

As one aspect of the invention, a mechanism for use in a railway switch machine is provided. The mechanism comprises: an elongate contact body comprising a housing formed from a non-conductive material; a plurality of electrical contact rails disposed in or on the contact body; and a contact block slidably coupled to the contact body such that the contact block can generally freely slide along the contact body in one or both of a first direction and an opposite second direction. The contact block has a plurality of moveable contacts positioned thereon facing the contact body. The contact block is structured to engage a point detector bar of the railway switch machine and the contact block is moveable along the contact body from among: a first position in which a first rail and a second rail of the plurality of electrical contact rails are electrically connected and a third rail and a fourth rail of the plurality of electrical contact rails are electrically connected and a second position in which only the second rail and the third rail are electrically connected.

The contact block may be further moveable along the contact body to a third position in which none of the first rail, the second rail, the third rail, or the fourth rail are electrically connected.

The third position may be between the first position and the second position.

The plurality of electrical contact rails may consist of the first rail, the second rail, the third rail, and the fourth rail and each of the rails may be disposed generally parallel with respect to each other as well as to the first and second directions.

Each electrical contact rail of the plurality of electrical contact rails may be positioned in a respective groove defined in the housing so as to have an outward facing surface of each electrical contact rail disposed flush or slightly recessed with an adjacent outer surface of the housing.

The second rail may extend continuously generally from a first end of the housing to an opposite second end of the housing and the third rail may extend continuously generally from the first end of the housing to the opposite second end of the housing generally parallel to the second rail.

Each of the second rail and the third rail may include a respective notch defined therein.

The respective notch of each of the second rail and the third rail may be disposed closer to the first end of the housing than the second end of the housing.

The first rail may include a first upper contact and a second upper contact which is electrically isolated from the first upper contact; the fourth rail may include a first lower contact and a second lower contact which is electrically isolated from the first lower contact; the contact body may further include an insulated block coupled to the housing and disposed in the notches of the second and third rails, between the first upper contact and the second upper contact of the first rail, and between the first lower contact and the second lower contact of the fourth rail; and when the contact block is disposed in the first position the first upper contact may be electrically connected to the second rail and the first lower contact may be electrically connected to the third rail.

The first rail may be disposed adjacent the second rail; the third rail may be disposed adjacent the second rail and opposite the first rail; and the fourth rail may be disposed adjacent the third rail and opposite the second rail.

Each electrical contact rail of the plurality of electrical contact rails may be coupled to the housing via a number of screws.

The housing may be formed from a glass reinforced epoxy laminate.

As another aspect of the invention, a railway switch machine is provided. The railway switch machine comprises: a point detector bar structured to be coupled to a moveable switch point of a railway and a mechanism such as previously described.

As yet another aspect of the invention a railway switching system is provided. The railway switching system comprises: a moveable switch point; and a railway switch machine comprising: a point detector bar coupled to the moveable switch point and a mechanism such as previously described.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

DETAILED DESCRIPTION OF EXEMPLARY EMBODIMENTS

Figure 1:
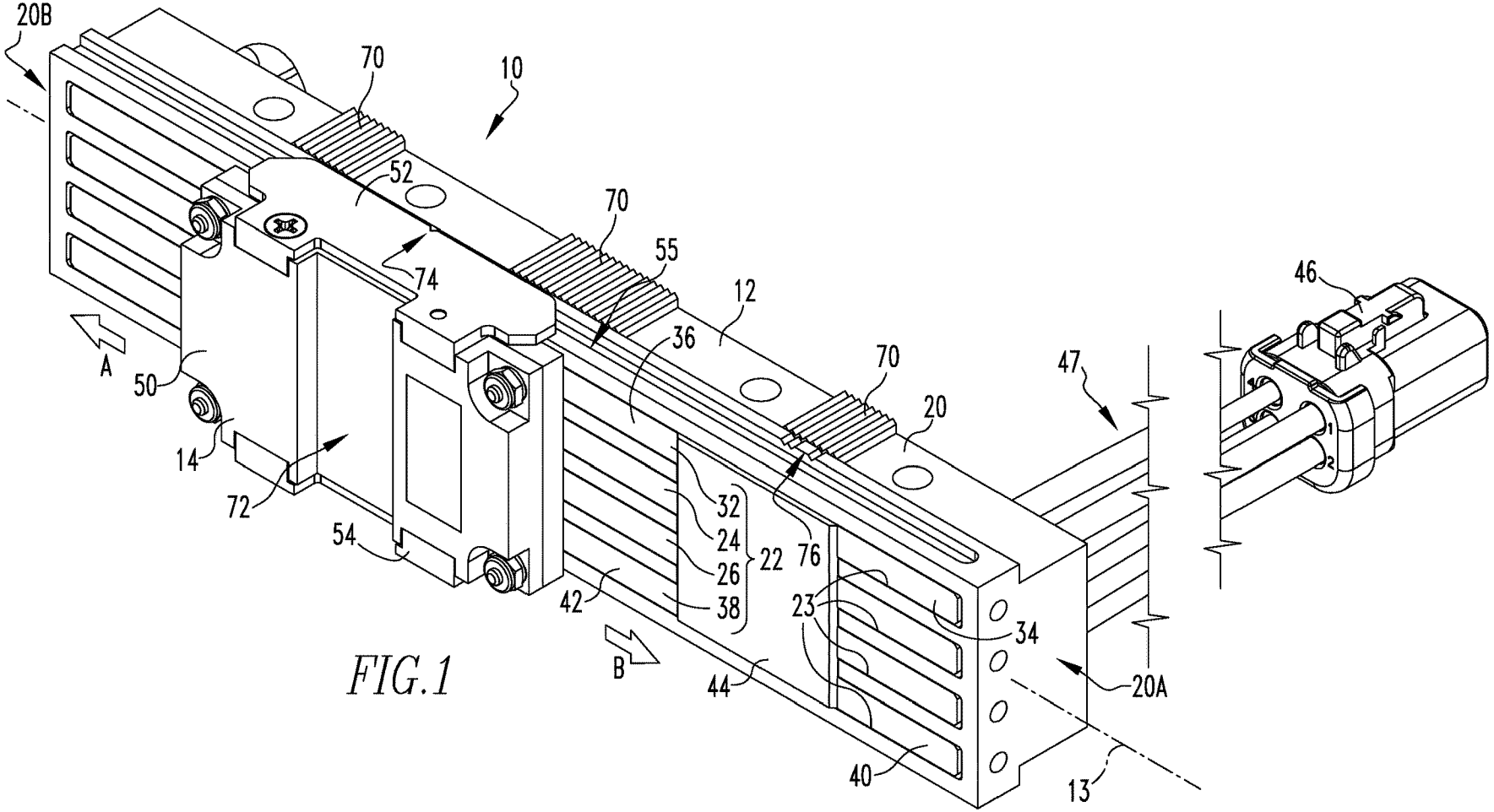
FIG. 1 is a front perspective view of a mechanism in accordance with an example embodiment of the disclosed concept.
Figure 2:
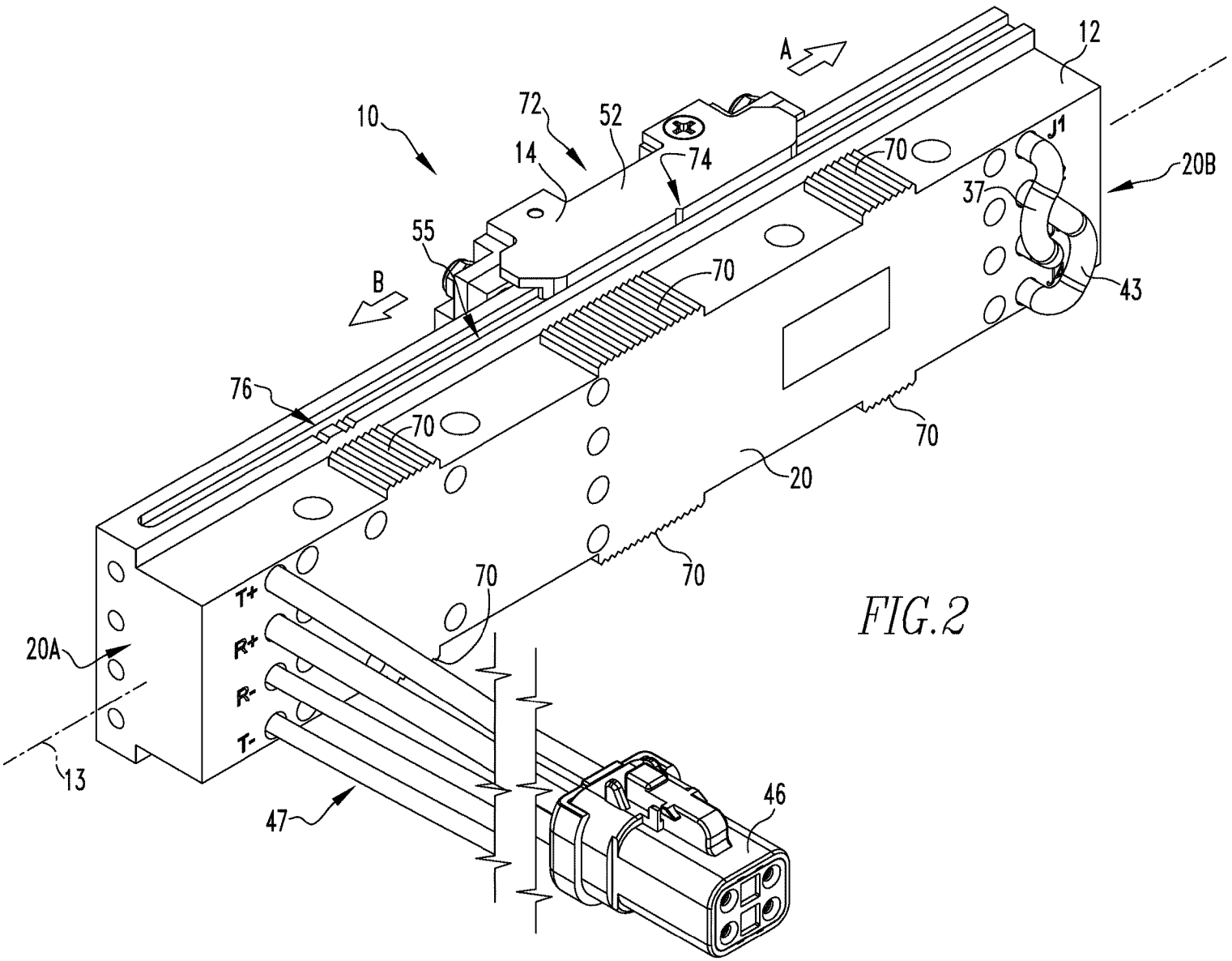
FIG. 2 is a rear perspective view of the mechanism of FIG. 1.
Figure 4:
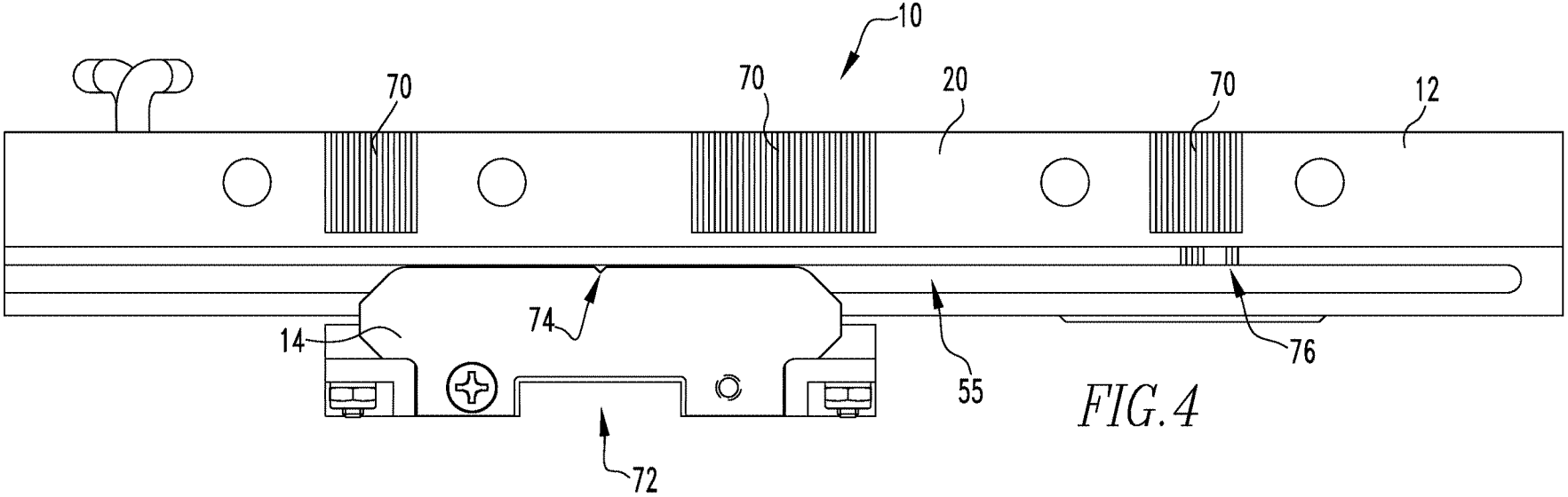
FIG. 4 is a top view of the mechanism of FIG. 1.
Figure 3:
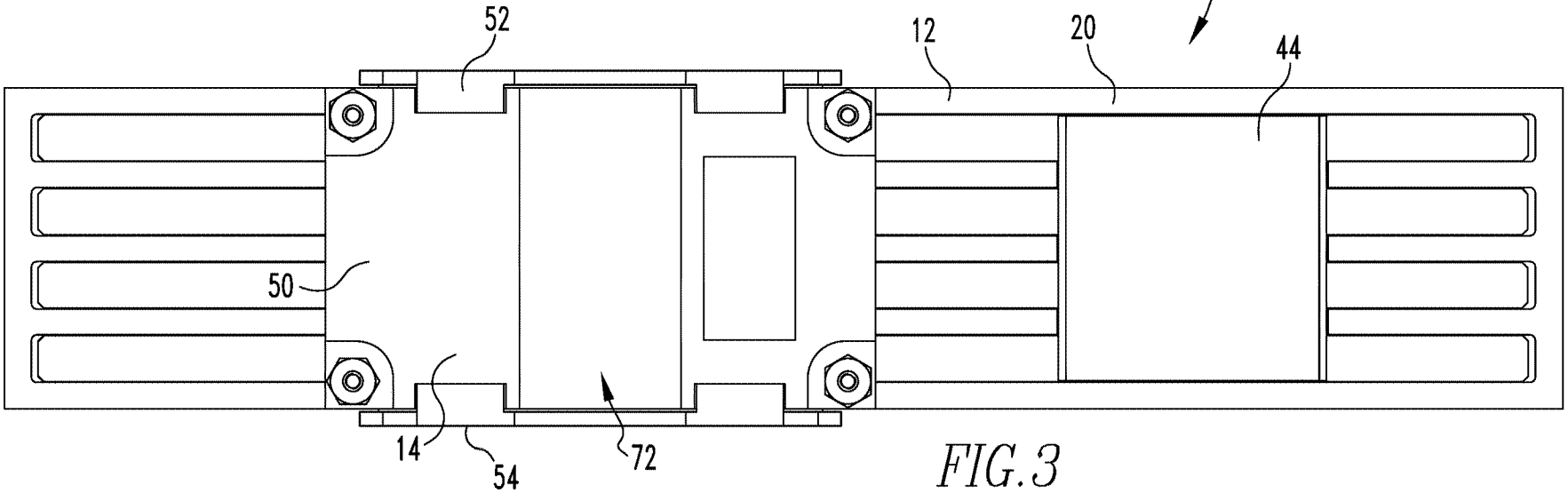
FIG. 3 is a front elevation view of the mechanism of FIG. 1.
Figure 5:
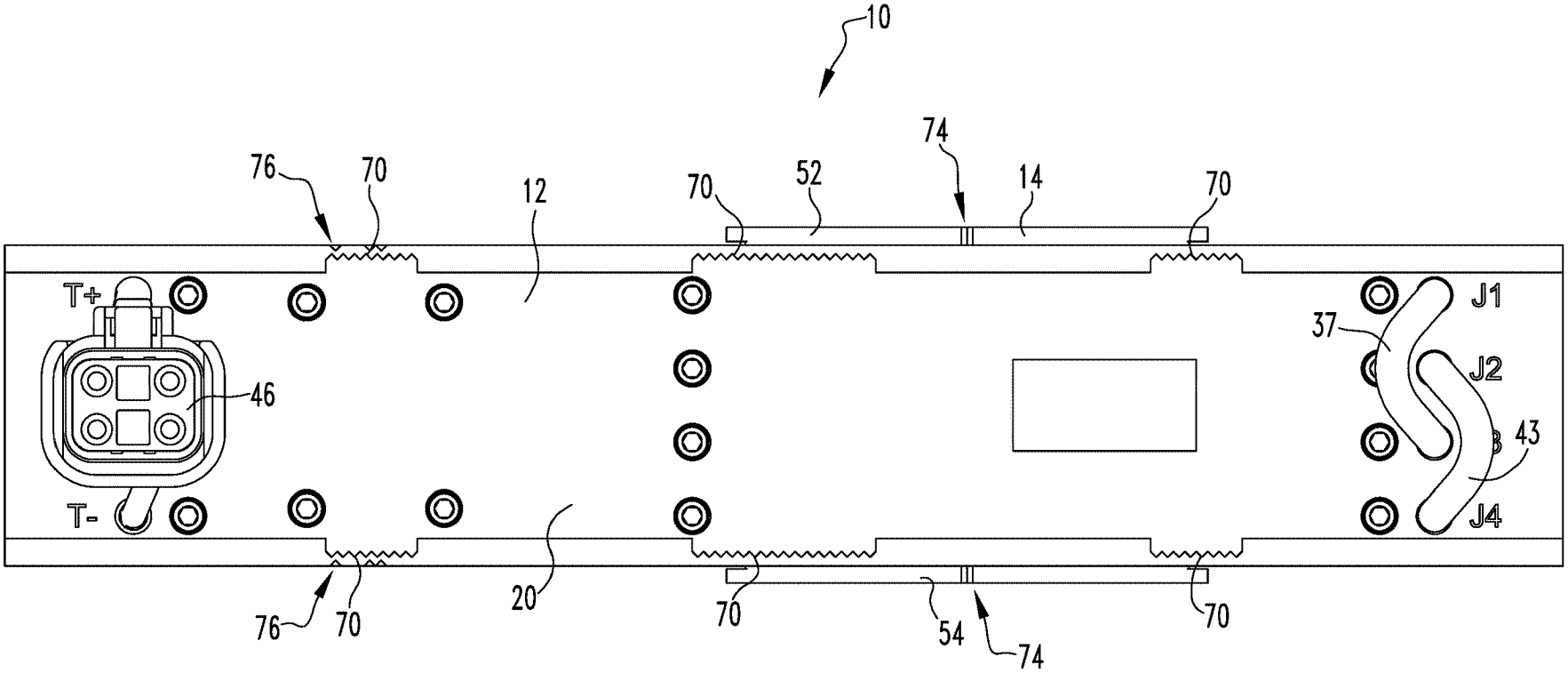
FIG. 5 is a rear elevation view of the mechanism of FIG. 1.
Figure 6:
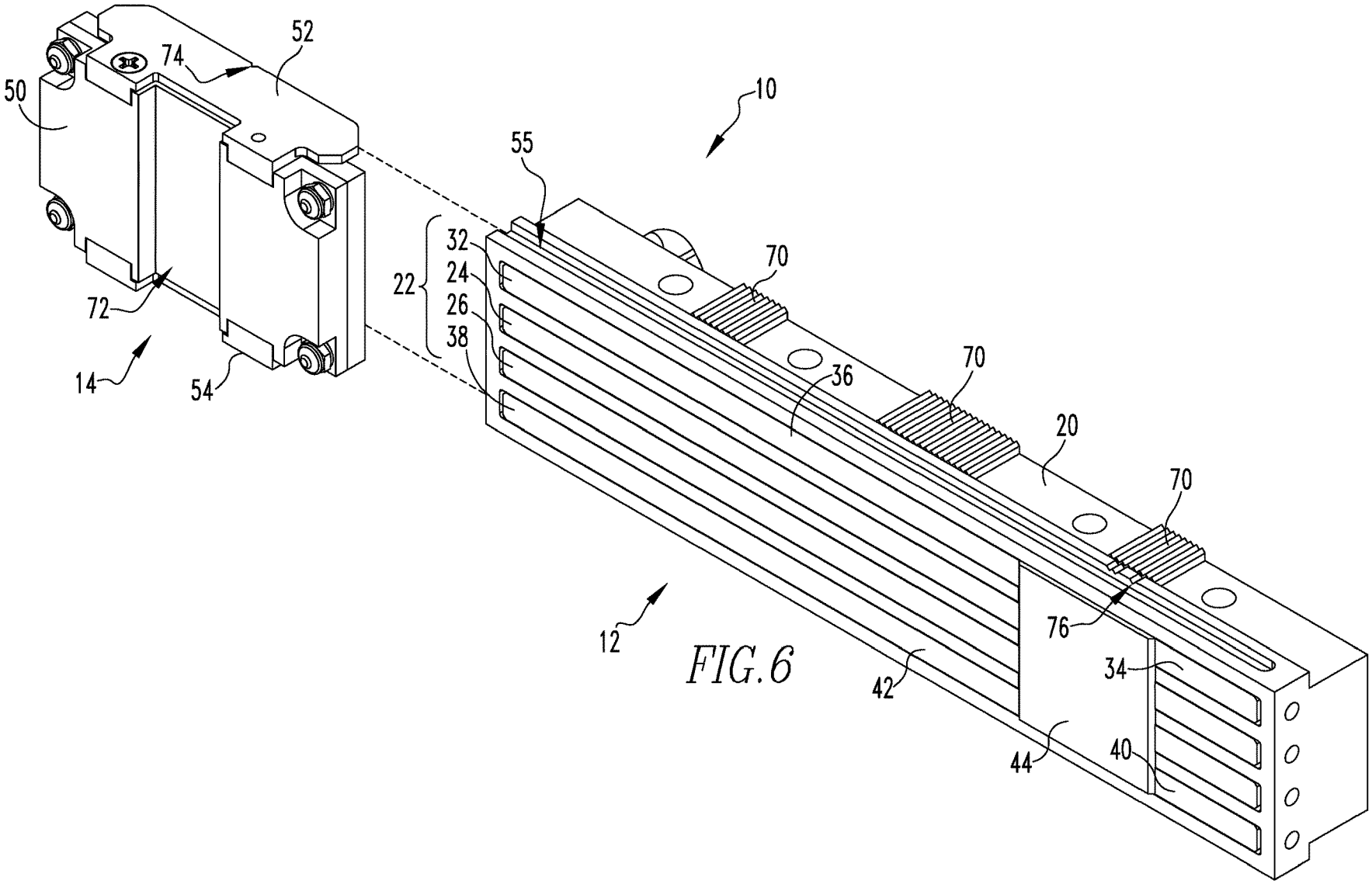
FIG. 6 is another front perspective view of the mechanism of FIG. 1 shown with a contact block thereof exploded from a contact body thereof.
Figure 7:
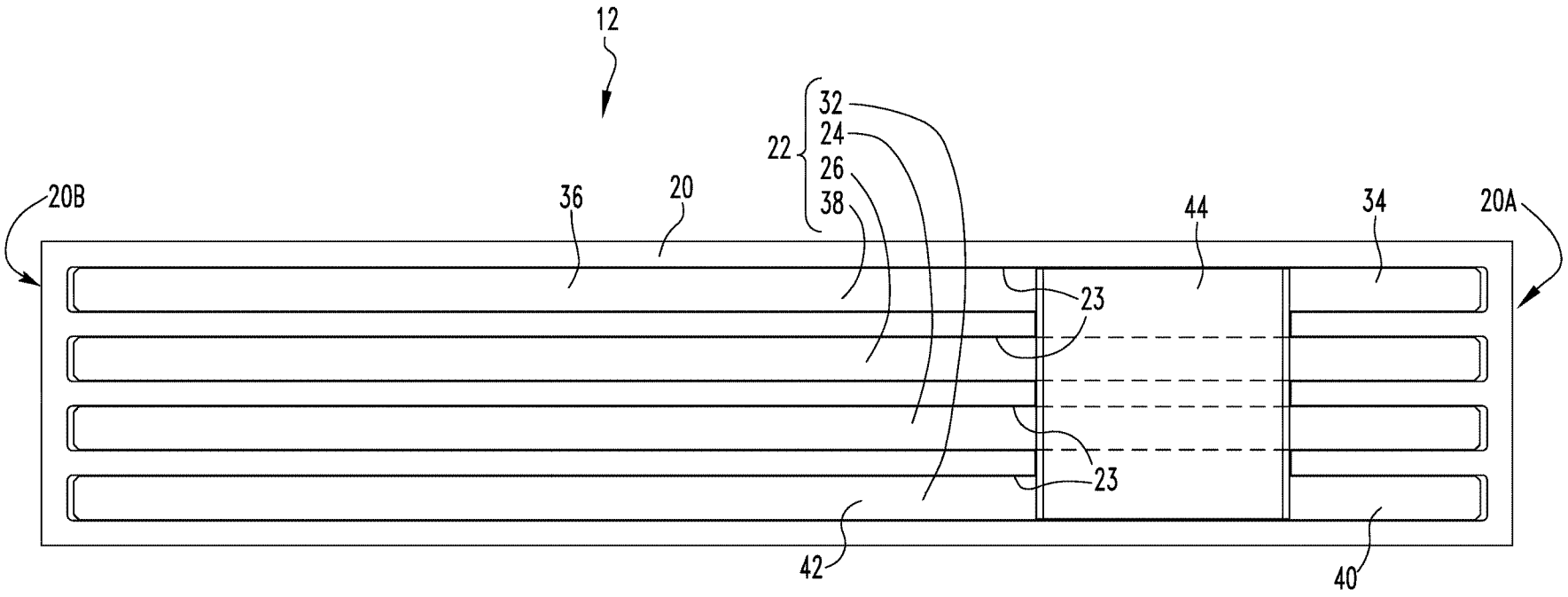
FIG. 7 is a front elevation view of the contact body of FIG. 6.

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

Embodiments of the present concept provide a simple, small-scale mechanical device/mechanism that mounts directly in the switch machine and is easily installed and removed when required. The mechanism is able to double break the track circuit signal and double shunt the rail when the point moves a calibrated distance. Some benefits of such mechanism are, without limitation: ease of installation; internal Switch Machine mounting position; small form factor; simple, rugged design; low cost.

An example mechanism 10 in accordance with an example embodiment of the disclosed concept is shown in FIGS. 1-6. Mechanism 10 is an assembly which includes an elongate contact body 12 disposed along a longitudinal axis 13 and a contact block 14 which is slidably coupled to contact body 12 such that contact block 14 can generally freely slide axially along axis 13 of contact body 12 in either of the directions shown by the arrows A, B in FIGS. 1 and 2, as will be discussed in further detail below. Continuing to refer to FIGS. 1-6, contact body 12 includes a frame or housing 20 which is formed from a non-conductive material, e.g., without limitation, a glass reinforced epoxy laminate or other suitable material, and a plurality of electrical contact rails 22 which are disposed therein or thereon. In an example embodiment of the disclosed concept, electrical contact rails 22 are formed from brass, however, it is to be appreciated that electrical contact rails 22 may be formed from one or more other suitable conductive materials without varying from the scope of the disclosed concept.

The example embodiment illustrated in the figures includes four electrical contact rails 22 disposed generally parallel with respect to each other as well as to axis 13 (and thus to the directions A, B of movement of contact block 14). Contact rails 22 are each positioned in respective grooves 23 of housing 20 so as to have an outward facing surface (not numbered) which is disposed flush, or preferably slightly recessed, with the adjacent outer surface (not numbered) of housing 20. Contact rails 22 include a first central contact rail 24 which extends continuously generally from a first end 20*a* of housing 20 to an opposite second end 20*b* of housing 20, and a second central contact rail 26 which similarly extends continuously generally from first end 20*a* of housing 20 to opposite second end 20*b* of housing 20 generally parallel to first central contact rail 24.

Figure 8:
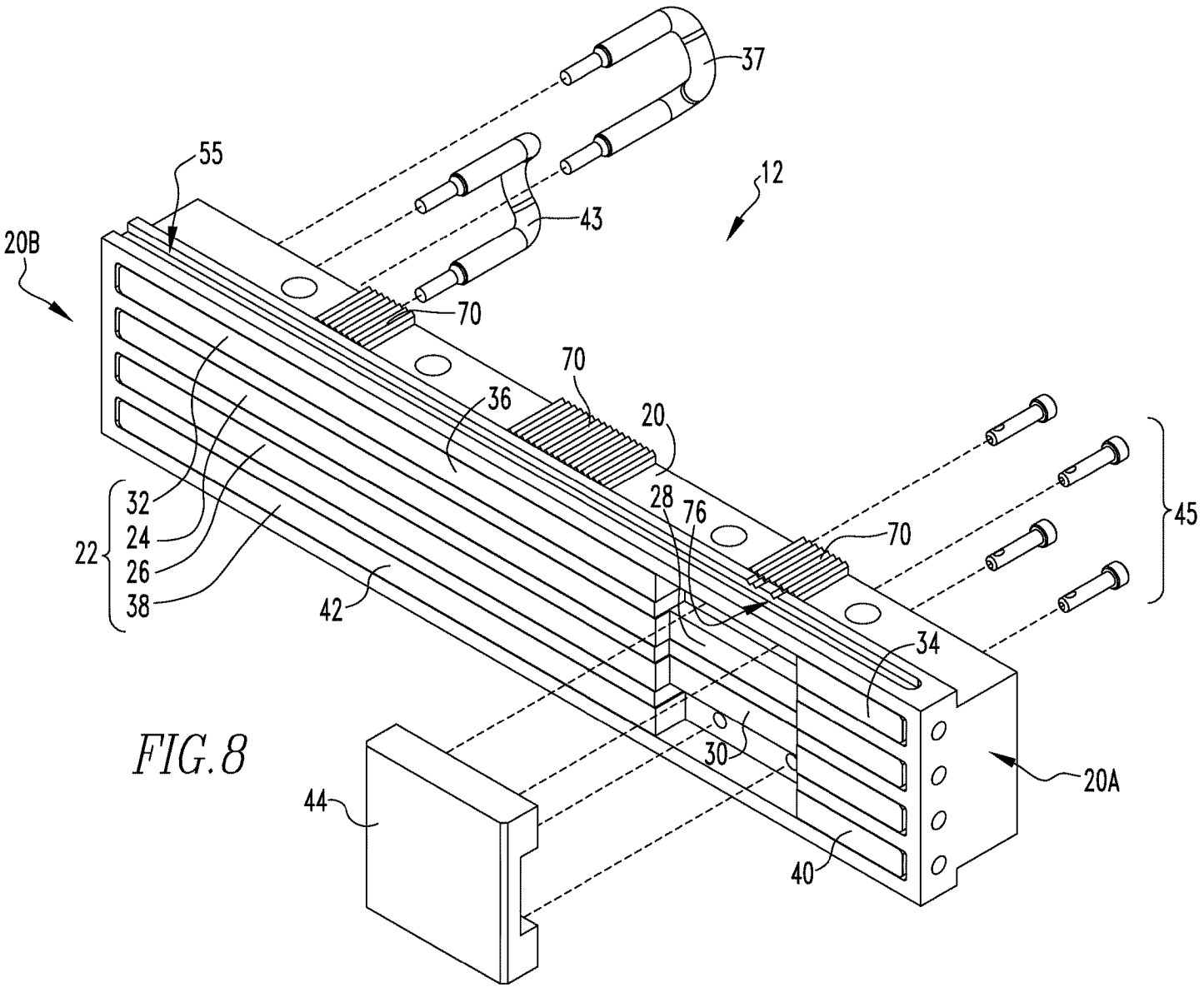
FIG. 8 is a partially exploded perspective view of the contact body of FIG. 6.
Figure 9:
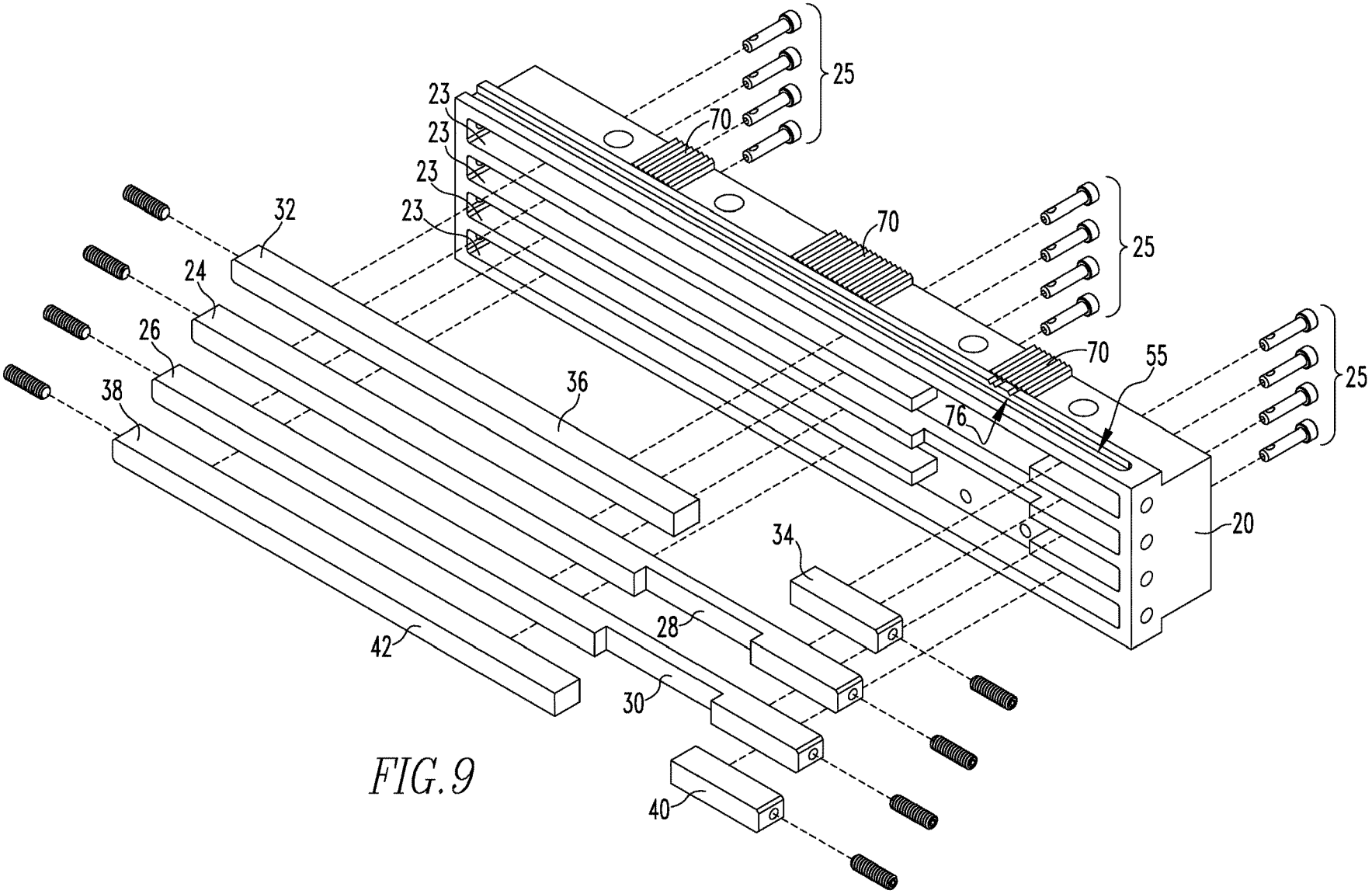
FIG. 9 is a further exploded perspective view of a portion of the contact body of FIG. 8.

As shown in the exploded views of FIGS. 8 and 9, each of first central contact rail 24 and second central contact rail 26 include a respective notch 28, 30 defined therein (the purpose of which is discussed below), which is disposed closer to first end 20*a* of housing 20 than second end 20*b* when each of first and second central contact rails 24 and 26 are positioned in housing 20. Electrical contact rails 22 further include a non-continuous upper rail 32 which includes a first upper contact 34 and a second upper contact 36 which is electrically isolated from first upper contact 34; and similarly a non-continuous lower rail 38 which includes a first lower contact 40 and a second lower contact 42 which is electrically isolated from first lower contact 40. In the illustrated example embodiment, electrical contact rails 22 are coupled to housing 20 via a plurality of screws 25 (shown schematically), however, it is to be appreciated that any suitable fastening arrangement may be employed without varying from the scope of the disclosed concept. Second upper contact 36 is electrically connected, e.g., via a jumper wire 37 or other suitable arrangement, to second central contact rail 26 and second lower contact 42 is electrically connected, e.g., via a jumper wire 43 or other suitable arrangement, to first central contact rail 24.

Each of first upper contact 34 of upper contact rail 32, first central contact rail 24, second central contact rail 26, and first lower contact 40 of lower contact rail 38 are structured to be electrically connected, to terminals T+, R+, R−, and T− in the motor compartment of a railway switch machine. These terminals correspond to specific connection points (Transmitter +/− and Receiver +/−) on the rails as part of the track circuit. The track circuit exists without this device, this device is installed in the track circuit and acts as a switch to open/shunt the circuit. Such terminals in the motor compartment are railroad specific threaded terminal posts which act as the junction between the internal device wiring and the external track circuit wiring. In the example embodiment illustrated in the figures, mechanism 10 includes an electrical connector 46 electrically connected via flexible insulated wires 47 to each of first upper contact 34, first central contact rail 24, second central contact rail 26, and first lower contact 40 for connecting to the previously mentioned track circuit. The purpose of such electrical connections previously described will be appreciated from the further descriptions provided below.

Contact body 12 further includes an insulated block 44 (e.g., formed from the same material as housing 20, or any other suitable non-conductive material) which is disposed in notches 28 and 30 of central rails 24 and 26, between first upper contact 34 and second upper contact 36, between first lower contact 40 and second lower contact 42, and coupled to housing 20 (e.g., via screws 45).

Figure 10:
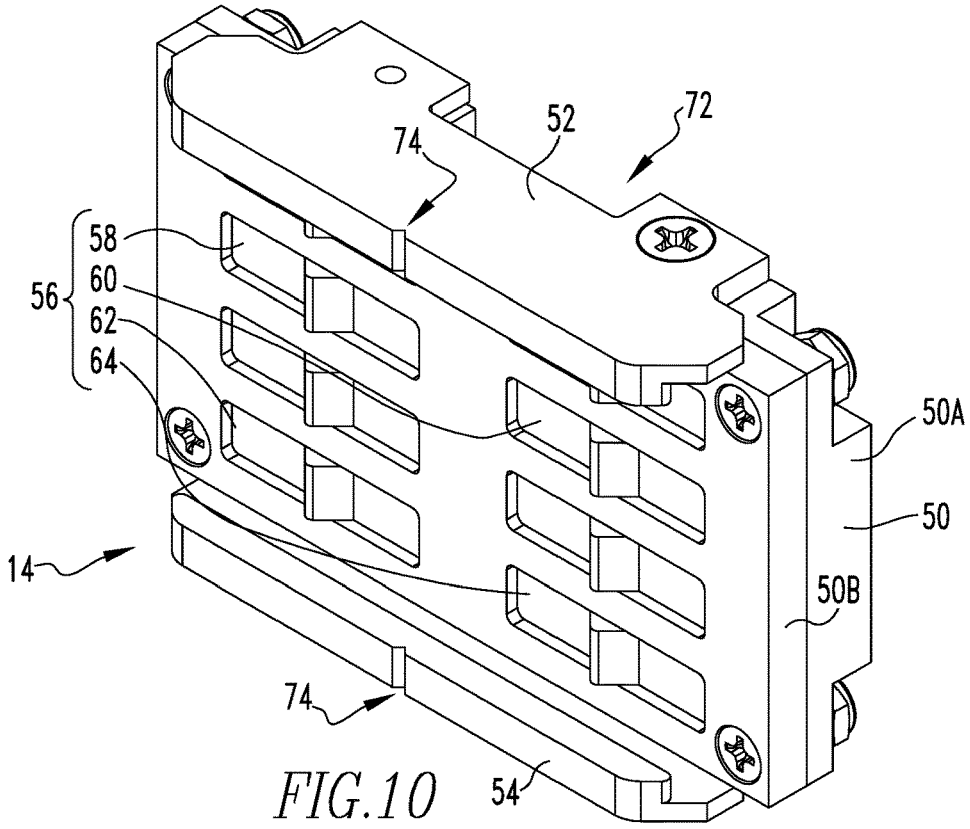
FIG. 10 is a perspective rear view of the contact block of FIG. 6.
Figure 11:
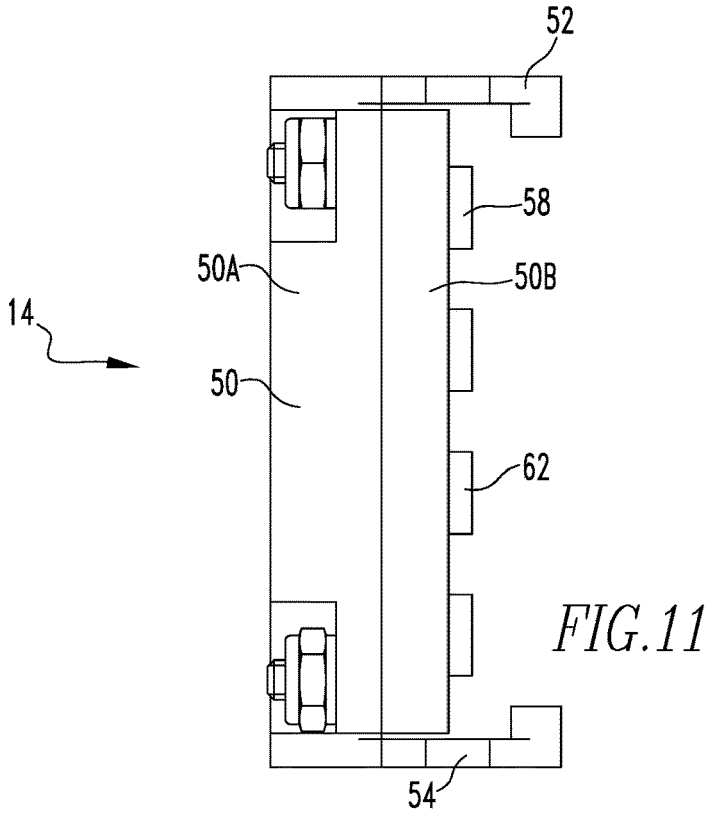
FIG. 11 is an end elevation view of the contact block of FIG. 6.

Referring now to FIGS. 10 and 11, contact block 14 includes a main housing 50 which is formed from a non-conductive material, e.g., without limitation, a glass reinforced epoxy laminate or other suitable material. In the example embodiment illustrated, main housing 50 is formed from a first main housing portion 50A and a second main housing portion 50B which may be coupled together via any suitable fastening arrangement. Contact block 14 further includes an upper slide bracket 52 and a lower slider bracket 54 which are each sized and configured to engage contact body 12 in a manner such that contact block 14 is readily slidable along contact body 12 such as previously discussed. In the example embodiment illustrated, each slider bracket 52 engages a groove 55 defined in a top portion of housing 20 and slider bracket 54 engages a similar groove (not labeled) formed on an opposite bottom portion of housing 20. A suitable lubricant (e.g., without limitation, spindle oil, dielectric grease, etc.) may be employed between portions of contact block 14 and contact body 12 to provide for smooth sliding action of contact block 14 along contact body 12.

Figure 12:
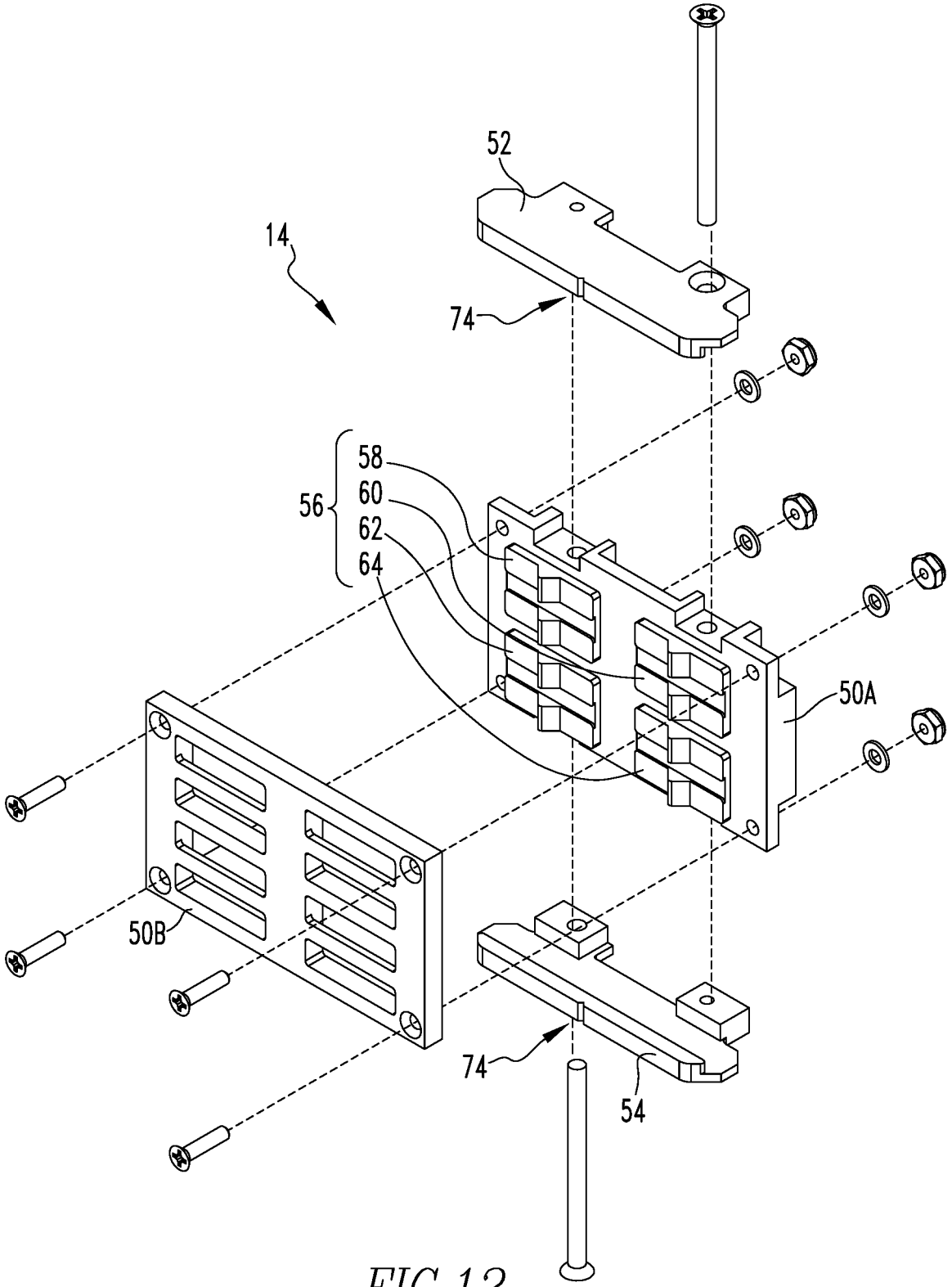
FIG. 12 is a partially exploded perspective view of the contact block of FIG. 6.
Figure 13:
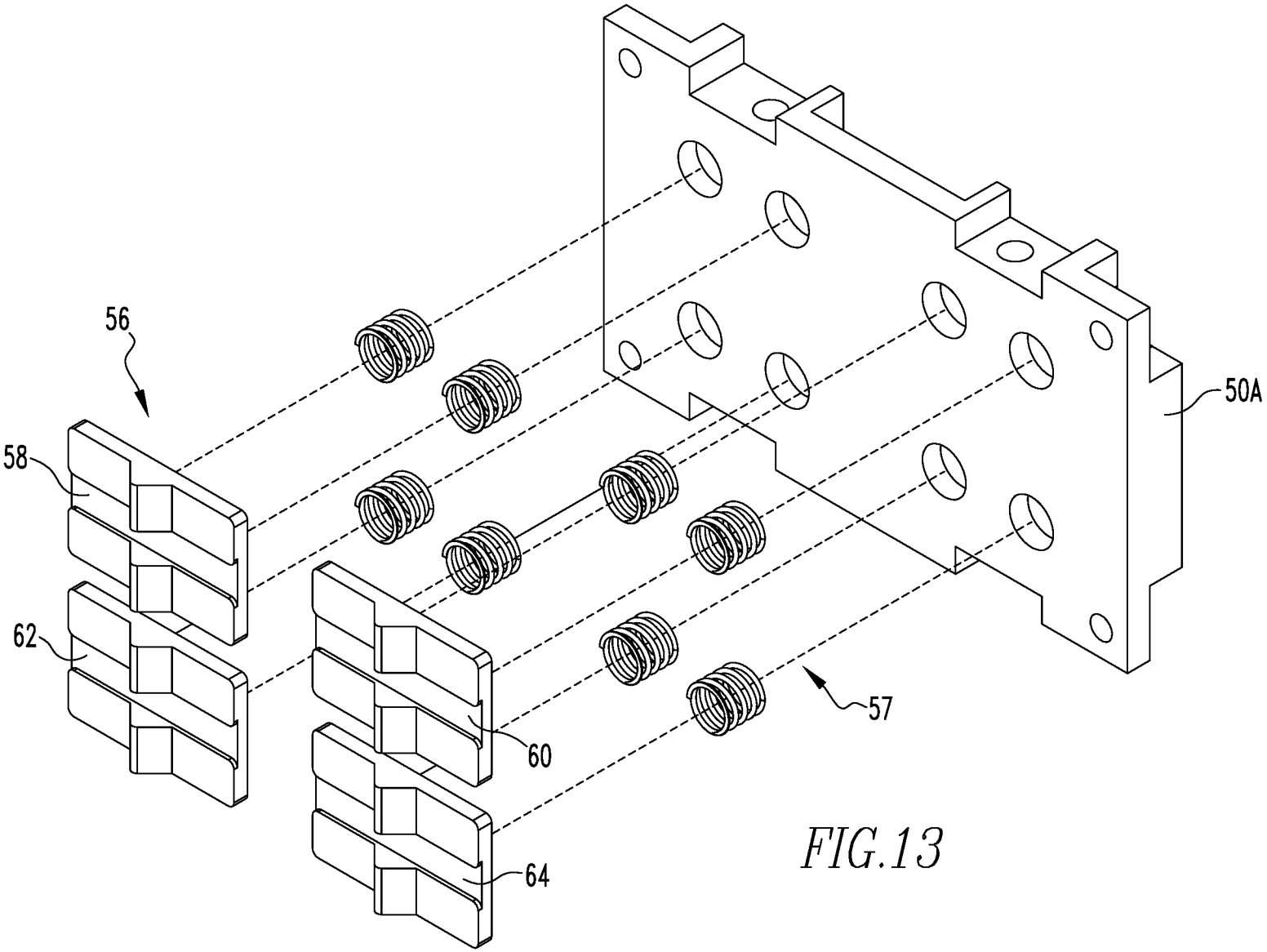
FIG. 13 is a further exploded view of a portion of the contact block of FIG. 12.

Continuing to refer to FIGS. 10 and 11, and additionally to the exploded views of FIGS. 12 and 13, contact block 14 further includes a plurality of independent movable electrical contacts 56 which are positioned on housing 50 and biased generally away from housing 50 (and toward contact body 12) via a number of springs 57 (such as shown in FIG. 13) or via any other suitable mechanism(s). In the example embodiment illustrated in the figures, movable electrical contacts 56 include four separate, electrically isolated contacts identified herein as first upper movable contact 58, second upper movable contact 60, first lower movable contact 62 and second lower movable contact 64. Each of movable contacts 58, 60, 62 and 64 are sized and configured to be able to engage two adjacent contact rails 22 when contact block 14 is coupled to contact body 12, as will be discussed in further detail below. In an example embodiment of the disclosed concept, movable electrical contacts 56 are formed from brass, however, it is to be appreciated that movable electrical contacts 56 may be formed from one or more other suitable conductive materials without varying from the scope of the disclosed concept.

Figure 14:
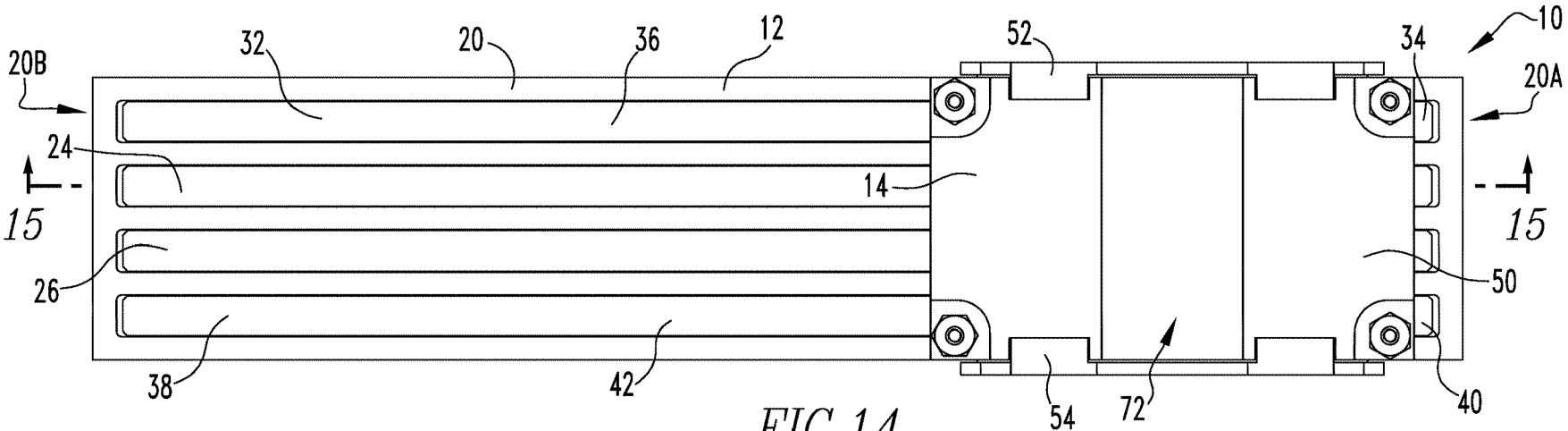
FIG. 14 is a front elevation view of the mechanism of FIG. 1 shown with the contact block thereof disposed in a different position on the contact body.
Figure 15:
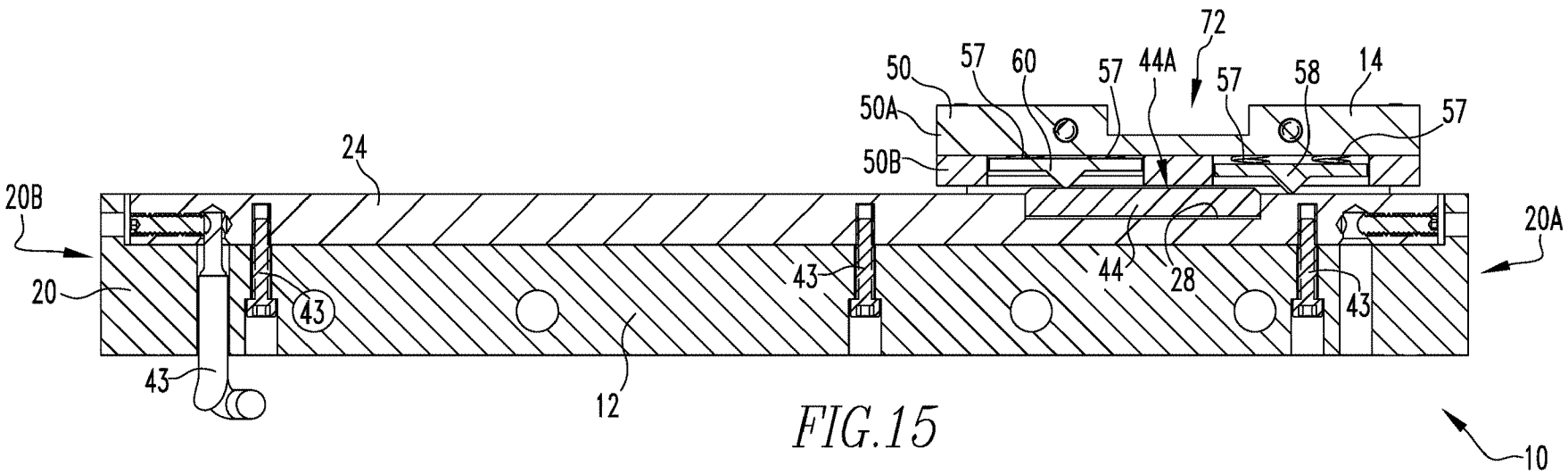
FIG. 15 is a sectional view of the mechanism of FIG. 14 taken along line 15-15 of FIG. 14.

Referring now to FIGS. 14 and 15, mechanism 10 is shown with contact block 14 positioned such that second upper movable contact 60 and second lower movable contact 64 are positioned on insulated block 44, and thus not in electrical contact with any of the contact rails. Meanwhile in such position first upper movable contact 58 is in electrical contact with first upper contact 34 of upper contact rail 32 as well as first central contact rail 24 while first lower moveable contact 62 is in electrical contact with second central contact rail 26 as well as first lower contact 40 of lower contact rail 38. In the example embodiment shown in section in FIG. 15, insulated block 44 is sized such that surface 44A thereof which faces contact block 14 is positioned a distance outward from the adjacent contact rails 22 and face of housing 20. Additionally, each movable contact 56 is formed with a central, generally triangular-shaped protruding portion (not numbered) which engages the corresponding contact rail 22 or insulated block 44. Such arrangement of insulated block 44 and moveable contacts 56 as shown in FIG. 15 has been found to minimize/eliminate potential unwanted arcing between contact rails 22 and moveable contacts 56.

Figure 16:
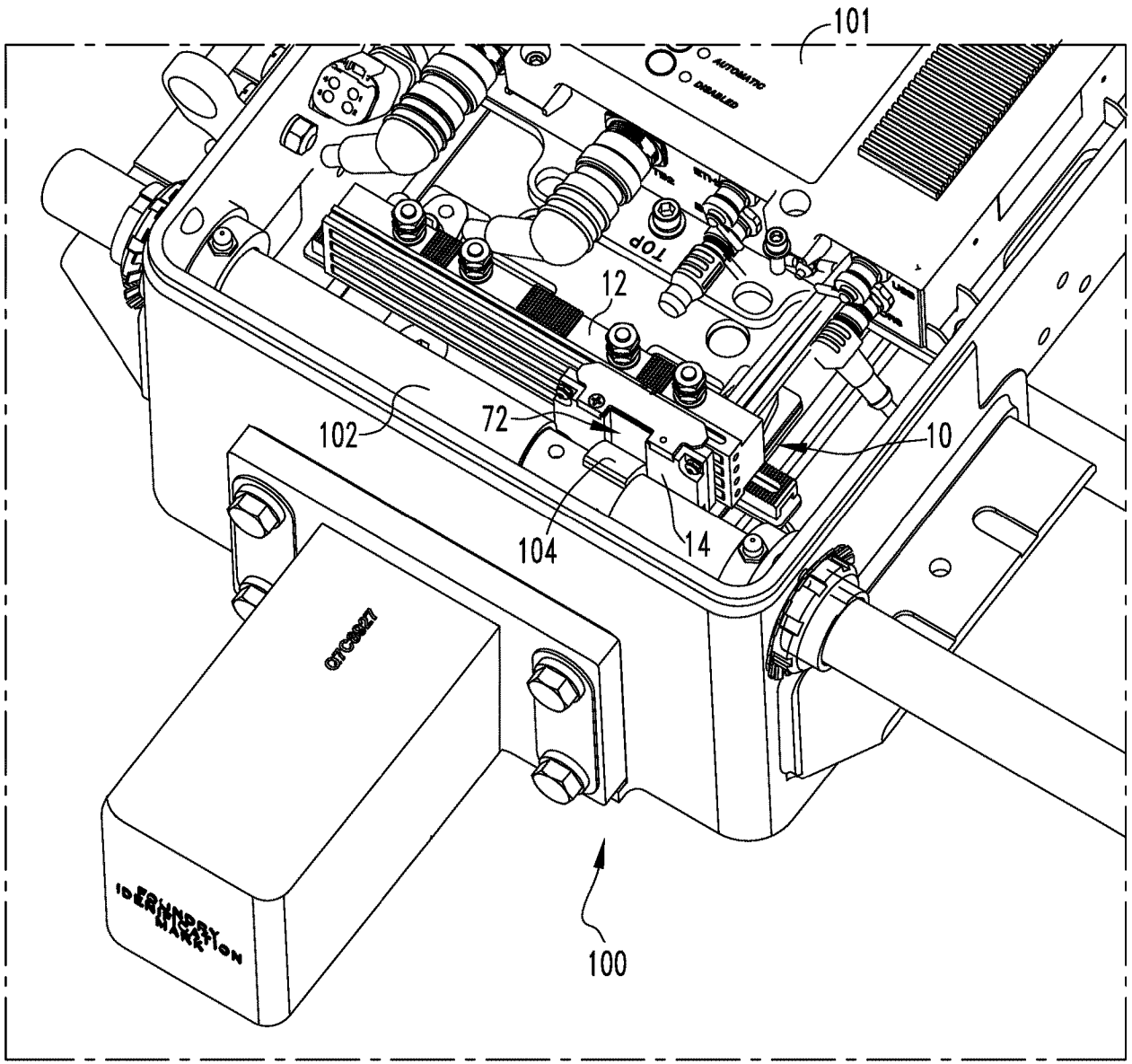
FIG. 16 is a perspective view of the mechanism of FIG. 1 shown disposed in a railway switch machine in accordance with one example embodiment of the disclosed concept.
Figure 17:
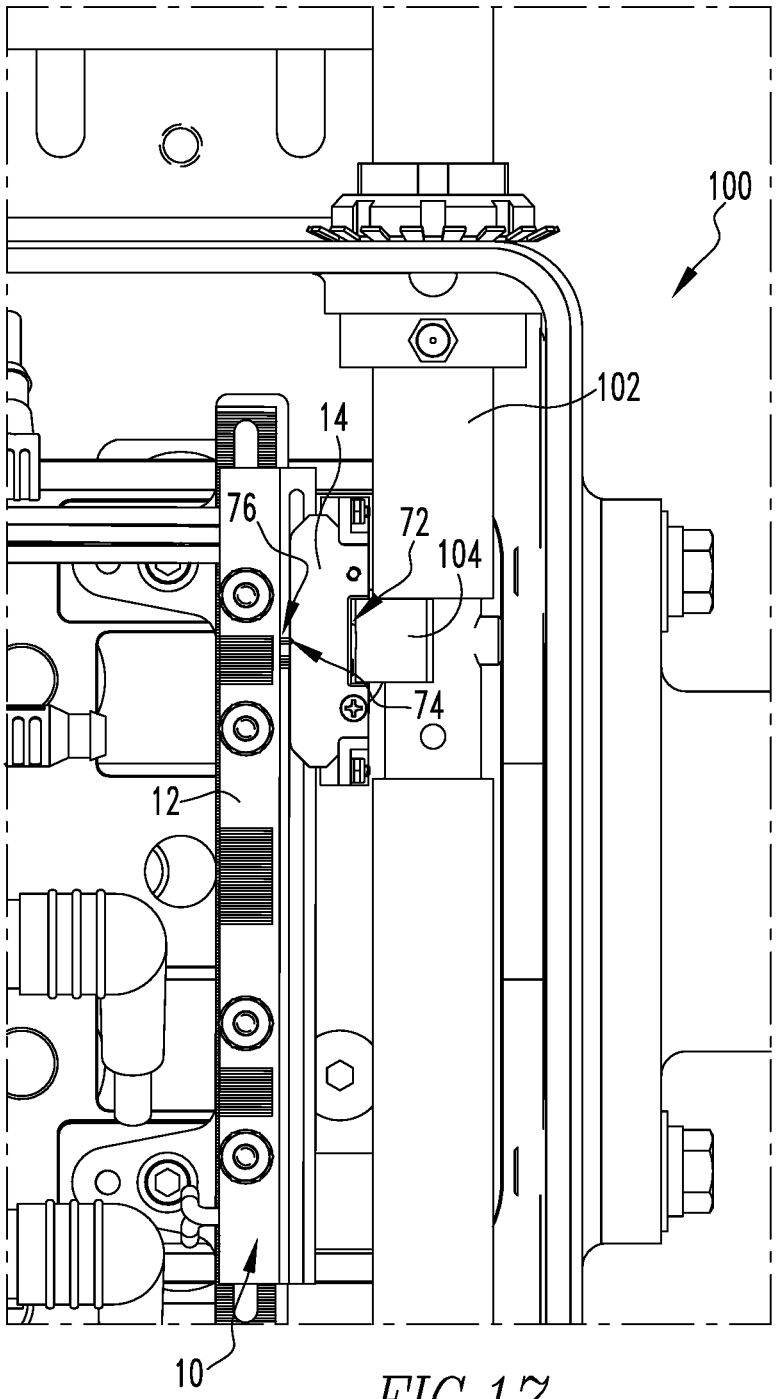
FIG. 17 is a top view of a portion of the arrangement of FIG. 16.

Referring now to FIGS. 16 and 17, in use, mechanism 10 is rigidly mounted inside a railway switch machine such as, for example, without limitation, a switch machine 100 (only a portion of which is shown) such as referenced in the Background section of this application with first upper contact 34 of upper contact rail 32, first central contact rail 24, second central contact rail 26, and first lower contact 40 of lower contact rail 38 electrically connected to the transmitter and receiver circuits (discussed further below) of the track circuit via suitable connections (e.g., without limitation, those previously discussed herein). Accordingly, contact body 12 is structured to be rigidly mounted in the switch machine circuit controller compartment (not numbered) of switch machine 100. In such example embodiment, contact body 12 is rigidly mounted to the existing point sensor bracket (not numbered) adjacent a point detector bar 102 of switch machine 100 which is coupled to a movable switch point (not shown). In order to provide for precisely adjustable placement of contact body 12 with respect to switch machine 100 and point detector bar 102, contact body 12 may be provided with a number of grooved or ridged areas 70 which are sized and configured to engage cooperatively sized structures (not shown) provided in switch machine 100. In the example embodiment illustrated herein, ridged areas 70 are formed in both the top and bottom surfaces of housing 20 of contact body 12 so as to allow for mechanism 10 to be mounted with either of the "top" or the "bottom" surface to be mounted in a downward position in a switch machine in contact with the corresponding ridged surfaces of the switch machine. It is to be appreciated, however, that ridged areas 70 may be provided via any other suitable arrangement and may be provided only on one of the bottom or top surface of contact body 12 without varying from the scope of the present invention.

Continuing to refer to FIGS. 16 and 17, contact block 14 is engaged with point detector bar 102 via a point detector target 104 which is coupled to point detector bar 102. In the example embodiment illustrated in the figures, point detector target 104 engages a recess 72 defined in a surface (not numbered) of contact block 14 opposite movable electrical contacts 56. As a result of such arrangement, as the point detector bar/target 102/104 move in conjunction with the switch point(s), contact block 14 moves by sliding along contact body 12. Accordingly, contact body 12 is of at least sufficient length to allow for a full point throw when required.

When installed in switch machine 100, the position of contact body 12 of mechanism 10 along the bracket is adjusted such that when the switch points are in their normal and locked position, a notch or other indicia 74 provided on contact block 14 is aligned with a matching notch or indicia 76 provided on contact body 12. This position of contact block 14 relative to contact body 12 is the normal position of mechanism 10.

Figure 18:
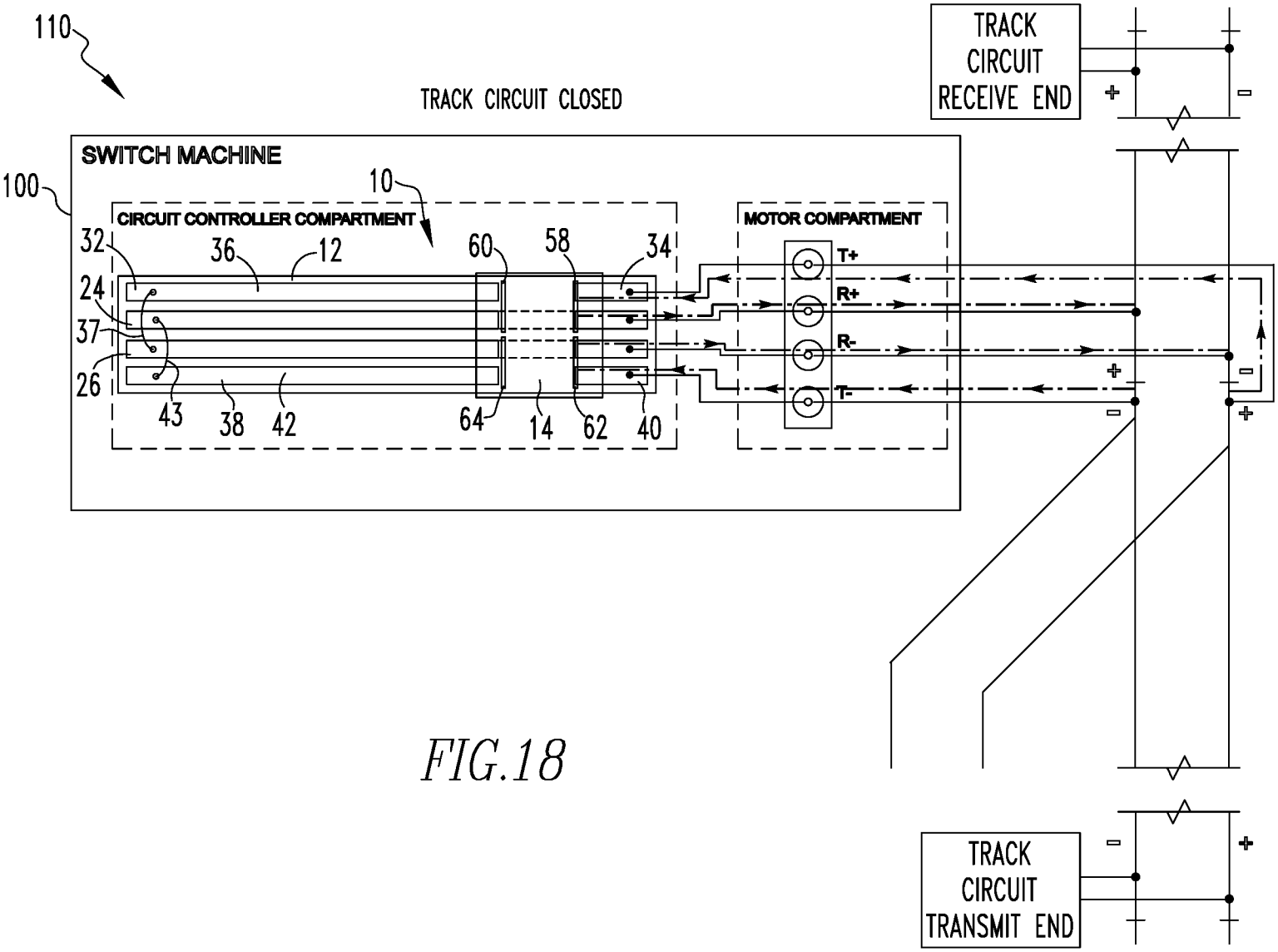
FIGS. 18-20 show schematic representations of a railway switching system having a mechanism such as shown in FIG. 1 in accordance with an example embodiment of the disclosed concept with the contact block thereof disposed in three different positions with respect to the contact body.
Figure 19:
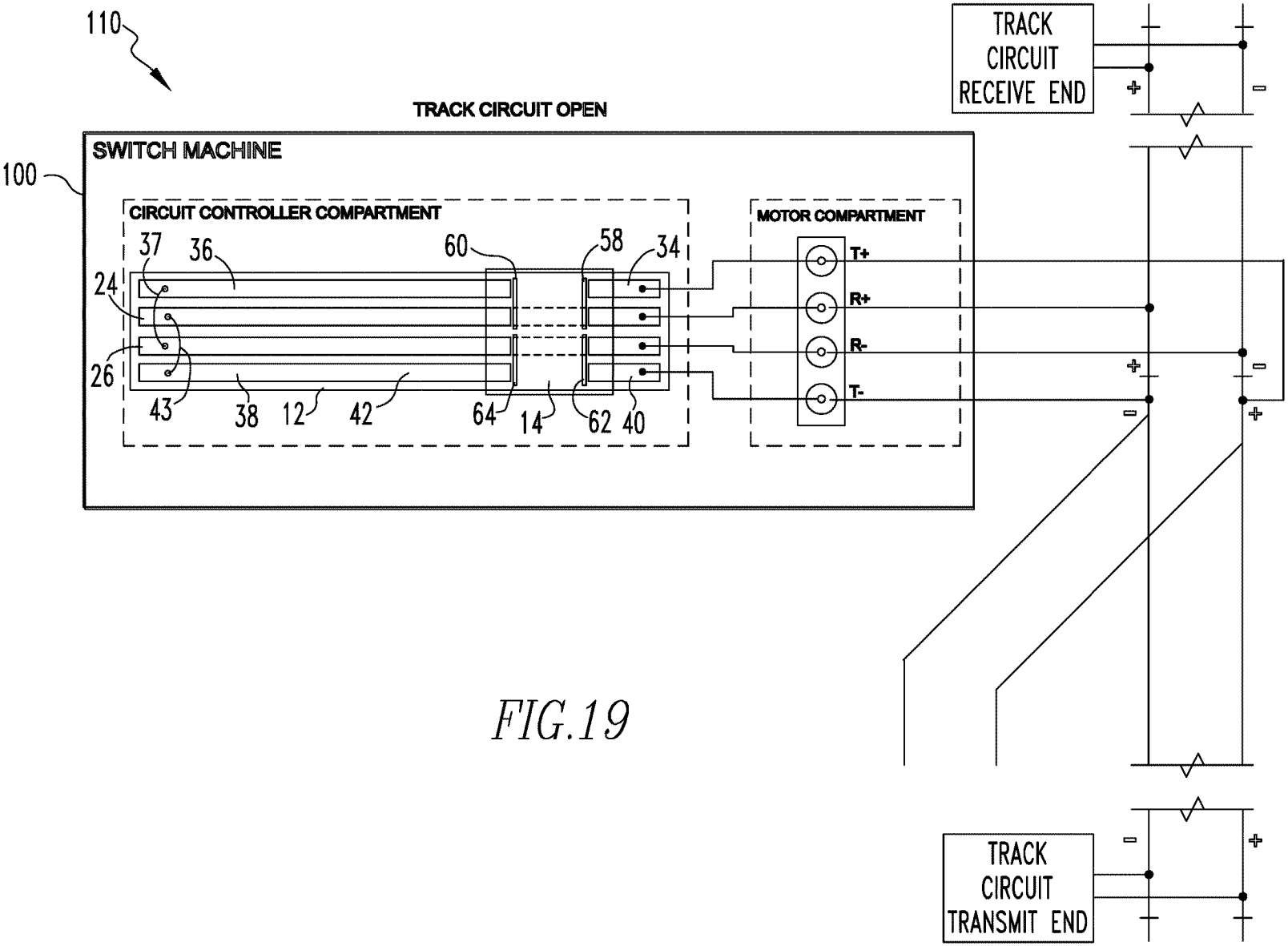
Figure 20:
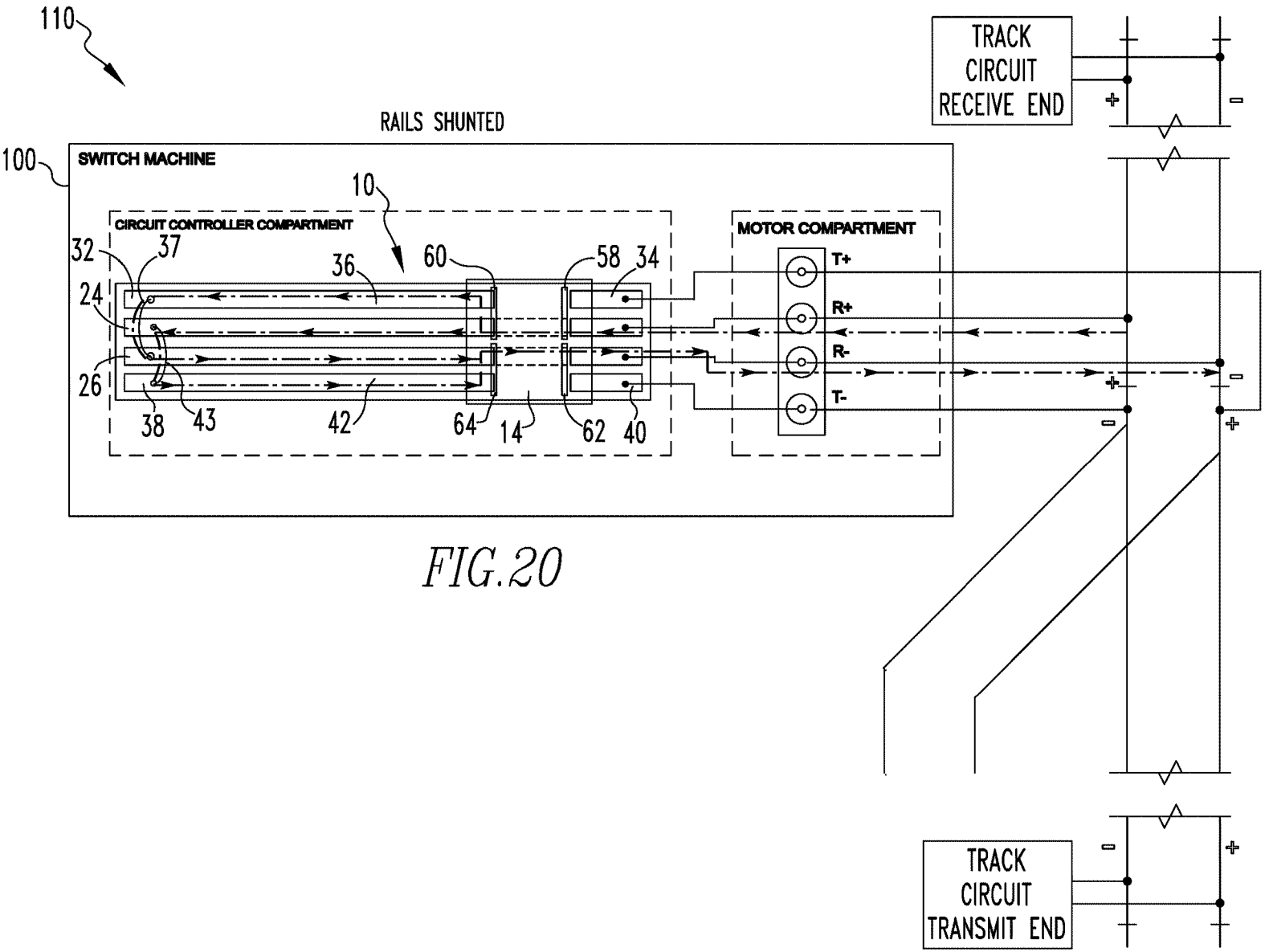

Having thus described the basic mechanical arrangement of mechanism 10 an example of the electrical connection and operation thereof in a railway switching system 110 will now be briefly discussed in conjunction with FIGS. 18-20. In such embodiment, first upper contact 34 and first lower contact 40 of contact body 12 are electrically connected respectively to the positive (+) and negative (−) track circuit transmitter leads T+ and T−. Meanwhile, first central contact rail 24 and second central contact rail 26 are electrically connected respectively to the positive (+) and negative (−) track circuit receiver leads R+ and R−.

Referring first to FIG. 18, contact block 14 is disposed in its adjusted normal position (i.e., when notches 74 and 76 are aligned) and thus the monitored switch point is tight against the rail. In such "normal" first position, first upper movable contact 58 is in electrical contact with both of first upper contact 34 of upper contact rail 32 as well as first central contact rail 24, while first lower moveable contact 62 is in electrical contact with second central contact rail 26 as well as first lower contact 40 of lower contact rail 38. As shown by the dot dashed lines in FIG. 18, such arrangement thus provides for the positive track circuit transmitter lead T+ to be electrically connected to the positive track circuit receiver lead R+(via first upper contact element 34 of upper contact rail 32, first upper movable contact 58, and first central contact rail 24) and for the negative track circuit transmitter lead T− to be electrically connected to the negative track circuit receiver lead R− (via first lower contact 40 of lower contact rail 38, first lower movable contact 62, and second central contact rail 26) thus resulting in a double connection "track circuit closed" configuration. Simultaneously, the rail shunt circuit is open. This position provides indication to the end user that the switch points are acceptably locked in place. The normal position of contact block 14 allows the switch points to move a distance less than 3/16" from the fully closed position while maintaining the closed track circuit and opened rail shunt circuit.

When the switch points (and contact block 14) move a distance greater than 3/16" and less than 1/4" from the fully closed position, all four movable contacts 58, 60, 62 and 64 in contact block 14 are disconnected from the contact body rails 22 and are only in contact with insulated block 44, such as shown in FIG. 19. In such second positioning, the track circuit is open (i.e., a double break as both T+ and R+, as well as T− and R−, are no longer electrically connected), and the rail shunt circuit remains open.

Finally, in the third positioning of contact block 14 shown in FIG. 20, when the switch points move a distance greater than 1/4" from the fully closed position, second upper movable contact 60 is in electrical contact with both of second upper contact 36 of upper contact rail 32 as well as first central contact rail 24, while second lower moveable contact 64 is in electrical contact with both of second central contact rail 26 and second lower contact 42 of lower contact rail 38. As shown by the dot dashed lines in FIG. 20, such arrangement thus provides for the track circuit receiver lead R+ to be electrically connected to the negative track circuit receiver lead R− (via both of: i. first central contact rail 24, jumper 43, second lower contact 42 of lower contact rail 38, second lower moveable contact 64, and second central contact rail 26; as well as ii. first central contact rail 24, second upper movable contact 60 of upper contact rail 32, jumper 37, and second central contact rail 26), thus resulting in a "rails shunted" configuration. Simultaneously, the track circuit is open as first upper contact 34 and first lower contact 40 are not electrically connected (and thus T+ and T− are not electrically connected. It is to be appreciated that such example arrangement provide for a double shunt arrangement as both of moveable contacts 60 and 64 of contact block 14 provide electrical pathways between R+ and R−.

Although the present concept has been described in detail for the purpose of illustration based on what is currently considered to be the most practical and preferred embodiments, it is to be understood that such detail is solely for that purpose and that the concept is not limited to the disclosed embodiments, but, on the contrary, is intended to cover modifications and equivalent arrangements that are within the spirit and scope of the appended claims. For example, it is to be understood that the present concept contemplates that, to the extent possible, one or more features of any embodiment can be combined with one or more features of any other embodiment. It is also to be understood that example dimensions of components, lengths of switch travel, or any other numeric values provided herein are provided for exemplary purposes only and may be varied depending on a particular application of the disclosed concept.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

What is claimed is:

1. A mechanism for use in a railway switch machine, the mechanism comprising:

an elongate contact body comprising a housing formed from a non-conductive material;

a plurality of electrical contact rails disposed in or on the contact body; and a contact block slidably coupled to the contact body such that the contact block can generally freely slide along the contact body in one or both of a first direction and an opposite second direction, the contact block having a plurality of moveable contacts positioned thereon facing the contact body, wherein the contact block is structured to engage a point detector bar of the railway switch machine, and wherein the contact block is moveable along the contact body from among:

a first position in which a first rail and a second rail of the plurality of electrical contact rails are electrically connected and a third rail and a fourth rail of the plurality of electrical contact rails are electrically connected; and a second position in which only the second rail and the third rail are electrically connected.

2. The mechanism of claim 1, wherein the contact block is further moveable along the contact body to a third position in which none of the first rail, the second rail, the third rail, or the fourth rail are electrically connected.

3. The mechanism of claim 1, wherein the third position is between the first position and the second position.

4. The mechanism of claim 1, wherein the plurality of electrical contact rails consists of the first rail, the second rail, the third rail, and the fourth rail and each of the rails are disposed generally parallel with respect to each other as well as to the first and second directions.

5. The mechanism of claim 1, wherein each electrical contact rail of the plurality of electrical contact rails is positioned in a respective groove defined in the housing so as to have an outward facing surface of each electrical contact rail disposed flush or slightly recessed with an adjacent outer surface of the housing.

6. The mechanism of claim 1, wherein the second rail extends continuously generally from a first end of the housing to an opposite second end of the housing; and wherein the third rail extends continuously generally from the first end of the housing to the opposite second end of the housing generally parallel to the second rail.

7. The mechanism of claim 6, wherein each of the second rail and the third rail include a respective notch defined therein.

8. The mechanism of claim 7, wherein the respective notch of each of the second rail and the third rail is disposed closer to the first end of the housing than the second end of the housing.

9. The mechanism of claim 6, wherein the first rail includes a first upper contact and a second upper contact which is electrically isolated from the first upper contact;

wherein the fourth rail includes a first lower contact and a second lower contact which is electrically isolated from the first lower contact;

wherein the contact body further includes an insulated block coupled to the housing and disposed in the notches of the second and third rails, between the first upper contact and the second upper contact of the first rail, and between the first lower contact and the second lower contact of the fourth rail; and wherein when the contact block is disposed in the first position the first upper contact is electrically connected to the second rail and the first lower contact is electrically connected to the third rail.

10. The mechanism of claim 9, wherein the first rail is disposed adjacent the second rail; wherein the third rail is disposed adjacent the second rail and opposite the first rail; and wherein the fourth rail is disposed adjacent the third rail and opposite the second rail.

11. The mechanism of claim 1 wherein each electrical contact rail of the plurality of electrical contact rails is coupled to the housing via a number of screws.

12. The mechanism of claim 1, wherein the housing is formed from a glass reinforced epoxy laminate.

13. A railway switch machine comprising:

a point detector bar structured to be coupled to a moveable switch point of a railway; and a mechanism comprising:

an elongate contact body coupled adjacent the point detector bar, the contact body comprising a housing formed from a non-conductive material;

a plurality of electrical contact rails disposed in or on the contact body; and a contact block slidably coupled to the contact body such that the contact block can generally freely slide along the contact body in one or both of a first direction and an opposite second direction, the contact block having a plurality of moveable contacts positioned thereon facing the contact body, wherein the contact block is engaged with the point detector bar of the railway switch machine, and wherein the contact block is moveable along the contact body from among:

a first position in which a first rail and a second rail of the plurality of electrical contact rails are electrically connected and a third rail and a fourth rail of the plurality of electrical contact rails are electrically connected; and a second position in which only the second rail and the third rail are electrically connected.

14. The rail railway switch machine of claim 13, wherein the contact block is movable to a third position in which none of the first rail, the second rail, the third rail, or the fourth rail are electrically connected.

15. A railway switching system comprising:

a moveable switch point; and a railway switch machine comprising:

a point detector bar coupled to the moveable switch point; and a mechanism comprising:

an elongate contact body coupled adjacent the point detector bar, the contact body comprising a housing formed from a non-conductive material;

a plurality of electrical contact rails disposed in or on the contact body; and a contact block slidably coupled to the contact body such that the contact block can generally freely slide along the contact body in one or both of a first direction and an opposite second direction, the contact block having a plurality of moveable contacts positioned thereon facing the contact body, wherein the contact block is engaged with the point detector bar of the railway switch machine, and wherein the contact block is moveable along the contact body from among:

a first position in which a first rail and a second rail of the plurality of electrical contact rails are electrically connected and a third rail and a fourth rail of the plurality of electrical contact rails are electrically connected;

a second position in which none of the first rail, the second rail, the third rail, or the fourth rail are electrically connected; and a third position in which only the second rail and the third rail are electrically connected.

* * * * *